US009097117B2

(12) United States Patent
Charron et al.

(10) Patent No.: US 9,097,117 B2
(45) Date of Patent: Aug. 4, 2015

(54) TURBINE TRANSITION COMPONENT FORMED FROM AN AIR-COOLED MULTI-LAYER OUTER PANEL FOR USE IN A GAS TURBINE ENGINE

(75) Inventors: Richard C. Charron, West Palm Beach, FL (US); Daniel J. Pierce, Port St. Lucie, FL (US); Jay A. Morrison, Cocoa, FL (US); Ching-Pang Lee, Cincinnati, OH (US); Kenneth K. Landis, Tequesta, FL (US); Walter Marussich, Palm Beach Gardens, FL (US)

(73) Assignee: SIEMENS ENERGY, INC, Orlando, FL (US)

( * ) Notice: Subject to any disclaimer, the term of this patent is extended or adjusted under 35 U.S.C. 154(b) by 1298 days.

(21) Appl. No.: 12/945,943

(22) Filed: Nov. 15, 2010

(65) Prior Publication Data

US 2012/0121381 A1 May 17, 2012

(51) Int. Cl.

| | |
|---|---|
| ***F23R 3/46*** | (2006.01) |
| ***F01D 9/02*** | (2006.01) |
| ***F01D 25/12*** | (2006.01) |

(52) U.S. Cl.

CPC ..... *F01D 9/023* (2013.01); *F01D 25/12* (2013.01); *F05D 2260/201* (2013.01); *F23R 2900/03044* (2013.01)

(58) Field of Classification Search

CPC ... F01D 9/023; F01D 25/12; F05D 2260/201; F23R 2900/03044

USPC ..... 60/39.37, 752

See application file for complete search history.

(56) References Cited

U.S. PATENT DOCUMENTS

| | | | | |
|---|---|---|---|---|
| 4,719,748 | A * | 1/1988 | Davis et al. | 60/39.37 |
| 5,363,653 | A * | 11/1994 | Zimmermann et al. | 60/760 |
| 8,647,053 | B2 * | 2/2014 | Hsu et al. | 415/115 |
| 8,661,827 | B2 * | 3/2014 | Morimoto et al. | 60/752 |
| 2003/0106317 | A1 * | 6/2003 | Jorgensen et al. | 60/754 |
| 2006/0042255 | A1 * | 3/2006 | Bunker et al. | 60/752 |
| 2009/0260364 | A1 * | 10/2009 | Keller et al. | 60/753 |
| 2010/0071382 | A1 * | 3/2010 | Liang | 60/752 |
| 2010/0170259 | A1 * | 7/2010 | Huffman | 60/755 |
| 2010/0223931 | A1 * | 9/2010 | Chila et al. | 60/760 |
| 2010/0242487 | A1 * | 9/2010 | Davis et al. | 60/752 |
| 2010/0316492 | A1 * | 12/2010 | Charron et al. | 415/182.1 |

* cited by examiner

*Primary Examiner* — Ted Kim

(57) ABSTRACT

A cooling system for a transition duct for routing a gas flow from a combustor to the first stage of a turbine section in a combustion turbine engine is disclosed. The transition duct may have a multi-panel outer wall formed from an inner panel having an inner surface that defines at least a portion of a hot gas path plenum and an intermediate panel positioned radially outward from the inner panel such that at least one cooling chamber is formed between the inner and intermediate panels. The transition duct may also include an outer panel. The inner, intermediate and outer panels may include one or more metering holes for passing cooling fluids between cooling chambers for cooling the panels. The intermediate and outer panels may be secured with an attachment system coupling the panels to the inner panel such that the intermediate and outer panels may move in-plane.

14 Claims, 9 Drawing Sheets

TURBINE TRANSITION COMPONENT FORMED FROM AN AIR-COOLED MULTI-LAYER OUTER PANEL FOR USE IN A GAS TURBINE ENGINE

FIELD OF THE INVENTION

This invention is directed generally to gas turbine engines, and more particularly to components useful for routing gas flow from combustors to the turbine section of gas turbine engines.

BACKGROUND OF THE INVENTION

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades and turbine vanes must be made of materials capable of withstanding such high temperatures. Turbine blades, vanes, transitions and other components often contain cooling systems for prolonging the life of these items and reducing the likelihood of failure as a result of excessive temperatures.

SUMMARY OF THE INVENTION

This invention is directed to a cooling system for a transition duct for routing a gas flow from a combustor to the first stage of a turbine section in a combustion turbine engine. In one embodiment, the transition duct may have a multi-panel outer wall formed from an inner panel having an inner surface that defines at least a portion of a hot gas path plenum and an intermediate panel positioned radially outward from the inner panel such that one or more cooling chambers is formed between the inner and intermediate panels. In another embodiment, the transition duct may include an inner panel, an intermediate panel and an outer panel. The inner, intermediary and outer panels may include one or more metering holes for passing cooling fluids between cooling chambers for cooling the panels. The intermediary and outer panels may be secured with an attachment system coupling the panels to the inner panel such that the intermediary and outer panels may move in-plane.

The cooling system may be configured to be usable with any turbine component in contact with the hot gas path of a turbine engine, such as a component defining the hot gas path of a turbine engine. One such component is a transition duct. The transition duct may be configured to route gas flow in a combustion turbine subsystem that includes a first stage blade array having a plurality of blades extending in a radial direction from a rotor assembly for rotation in a circumferential direction, said circumferential direction having a tangential direction component, an axis of the rotor assembly defining a longitudinal direction, and at least one combustor located longitudinally upstream of the first stage blade array and may be located radially outboard of the first stage blade array. The transition duct may include a transition duct body having an internal passage extending between an inlet and an outlet. The transition duct may be formed from a duct body that is formed at least in part from a multi-panel outer wall. The multi-panel outer wall may be formed from an inner panel having an inner surface that defines at least a portion of a hot gas path plenum and an intermediate panel positioned radially outward from the inner panel such that at least one cooling chamber is formed between the inner and intermediate panels. The multi-panel outer wall may also include an outer panel positioned radially outward from the intermediate panel such that at least one cooling chamber is formed between the intermediate and outer panels.

The intermediate and outer panels may be supported by one or more ribs extending from the inner panel radially outward into contact the intermediate panel. In at least one embodiment, the cooling system may include a plurality of ribs. The intermediate panel may include one or more depressions between adjacent ribs such that a volume of the at least one cooling chamber between the inner and intermediate panels is reduced. The depression places metering holes closer to the inner panel for better impingement cooling. The intermediate panel includes a depression if the rib height is greater than the ideal impingement offset distance. There may be situations where the intermediate member is flat over the top of the ribs, or is actually raised rather than depressed between the ribs.

The intermediate panel may be supported by the plurality of ribs, wherein a portion of the intermediate panel straddles a rib such that a support pocket is formed in the intermediate panel. The support pocket may be formed by a support side protrusion formed on each side of the rib, wherein each support side protrusion of the support pocket extends radially inward toward the inner panel further than other portions of the intermediate panel. The ribs may have any appropriate configuration, and in at least one embodiment, may be tapered such that a cross-sectional area of the rib at the base is larger than a cross-sectional area of the rib at an outer tip.

In one embodiment, the outer panel may contact the intermediate panel at a location radially aligned with a point at which the intermediate panel contacts the at least one rib. In an alternative embodiment, a gap may exist between the intermediate panel and the outer panel at a location radially aligned with a point at which the intermediate panel contacts the at least one rib.

The cooling system may include one or more metering holes to control the flow of cooling fluids into the cooling chambers. In particular, the outer panel may include a plurality of metering holes. The intermediate panel may include one or more impingement holes, and the inner panel may include one or more film cooling holes.

The cooling system may include an attachment system. The attachment system may include one or more seal bodies integrally formed with the inner panel and having at least one portion extending radially outward with at least one pocket configured to receive a side edge of the intermediate panel in a sliding arrangement such that the intermediate panel is able to move in-plane relative to the attachment system and to receive a side edge of the outer panel in a sliding arrangement such that the outer panel is able to move in-plane relative to the attachment system. A sealing bracket may be releasably coupled to the seal body such that the seal bracket imposes a compressive force directed radially inward on the inner and intermediate panels.

The outer panel may be formed as a partial cylindrical structure such that at least two outer panels form a cylindrical structure. Similarly, the intermediate panel may be formed as a partial cylindrical structure such that at least two intermediate panels form a cylindrical structure.

During operation, hot combustor gases flow from a combustor into inlet of the transition duct. The gases are directed through the internal passage. Cooling fluids, such as, but not limited to air, may be supplied to the shell and flow through the metering holes in the outer panel into one or more cooling chambers wherein the cooling fluids impinge on the intermediate panel. The cooling fluids increase in temperature and pass through the metering holes in the intermediate panel an impinge on the inner panel. The depressions enable the metering holes to be positioned closer to the inner panel thereby increasing the impingement effect on the inner panel. The cooling fluids increasing in temperature and pass through the metering holes in the inner panel to form film cooling on of the inner surface of the inner panel.

The cooling system formed from a three-layered system is particularly beneficial for a transvane concept, where the hot gas flow is accelerated to a high Mach number, and the pressure drop across the wall is much higher than in traditional transition ducts. This high pressure drop is not ideal for film cooling, and an impingement panel alone is insufficient to reduce the post-impingement air pressure for ideal film cooling effectiveness. Therefore, the outer panel, which serves primarily as a pressure drop/flow metering device, is especially needed for this type of component.

Upstream portions of the transvane, where the hot gas path velocity is lower and the pressure difference across the wall is also lower, may benefit from the two wall construction, which, is the embodiment with the outer wall including the metering holes or wherein the intermediate panel with the impingement holes are sufficient to drop the pressure for film effectiveness.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF EMBODIMENTS OF THE INVENTION

Figure 10:
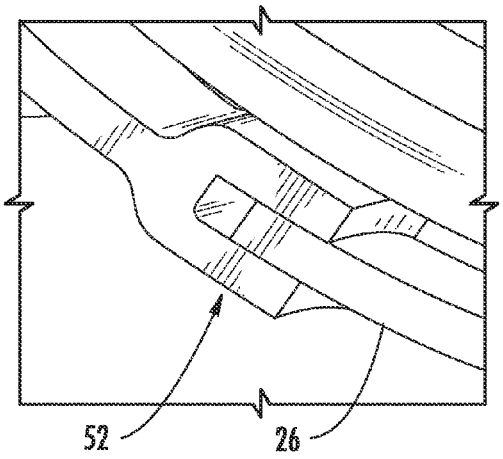
FIG. 10 is another aspect of the attachment system.
Figure 11:
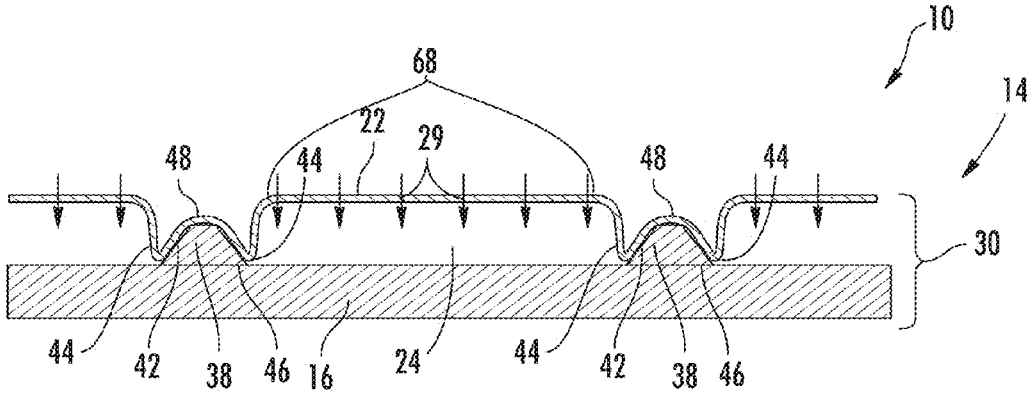
FIG. 11 is a partial cross-sectional view of an alternative embodiment of the multi-panel wall.

As shown in FIGS. 1-16, this invention is directed to a cooling system 10 for a transition duct 12 for routing a gas flow from a combustor (not shown) to the first stage of a turbine section in a combustion turbine engine. The transition duct 12 may have a multi-panel outer wall 14 formed from an inner panel 16 having an inner surface 18 that defines at least a portion of a hot gas path plenum 20 and an intermediate panel 22 positioned radially outward from the inner panel 16 such that one or more cooling chambers 24 is formed between the inner and intermediate panels 16, 22, as shown in FIG. 11. In another embodiment, the transition duct 12 may include an inner panel, a intermediate panel 22 and an outer panel 26. The outer panel 26 may include one or more metering holes 28 for passing cooling fluids into the cooling chambers 24, and the intermediate panel 22 may include one or more impingement holes 29. The inner panel 16 may include one or more film cooling holes 31 for cooling the inner panel 16. The intermediary and outer panels 22, 26 may be secured with an attachment system coupling the panels 22, 26 to the inner panel 16 such that the intermediary and outer panels 22, 26 may move in-plane.

The cooling system 10 may be configured to be usable with any turbine component in contact with the hot gas path of a turbine engine, such as a component defining the hot gas path of a turbine engine. One such component is a transition duct 12, as shown in FIGS. 1-4. The transition duct 12 may be configured to route gas flow in a combustion turbine subsystem that includes a first stage blade array having a plurality of blades extending in a radial direction from a rotor assembly for rotation in a circumferential direction. At least one combustor may be located longitudinally upstream of the first stage blade array and located radially outboard of the first stage blade array. The transition duct 12 may extend between the combustor and rotor assembly.

The transition duct 12 may be formed from a transition duct body 30 having an hot gas path plenum 20 extending between an inlet 34 and an outlet 36. The duct body 30 may be formed from any appropriate material, such as, but not limited to, metals and ceramics. The duct body 30 may be formed at least in part from a multi-panel outer wall 14. The multi-panel outer wall 14 may be formed from an inner panel 16 having an inner surface 18 that defines at least a portion of a hot gas path plenum 20 and an intermediate panel 22 positioned radially outward from the inner panel 16 such that one or more cooling chambers 24 is formed between the inner and intermediate panels 16, 22.

Figure 1:
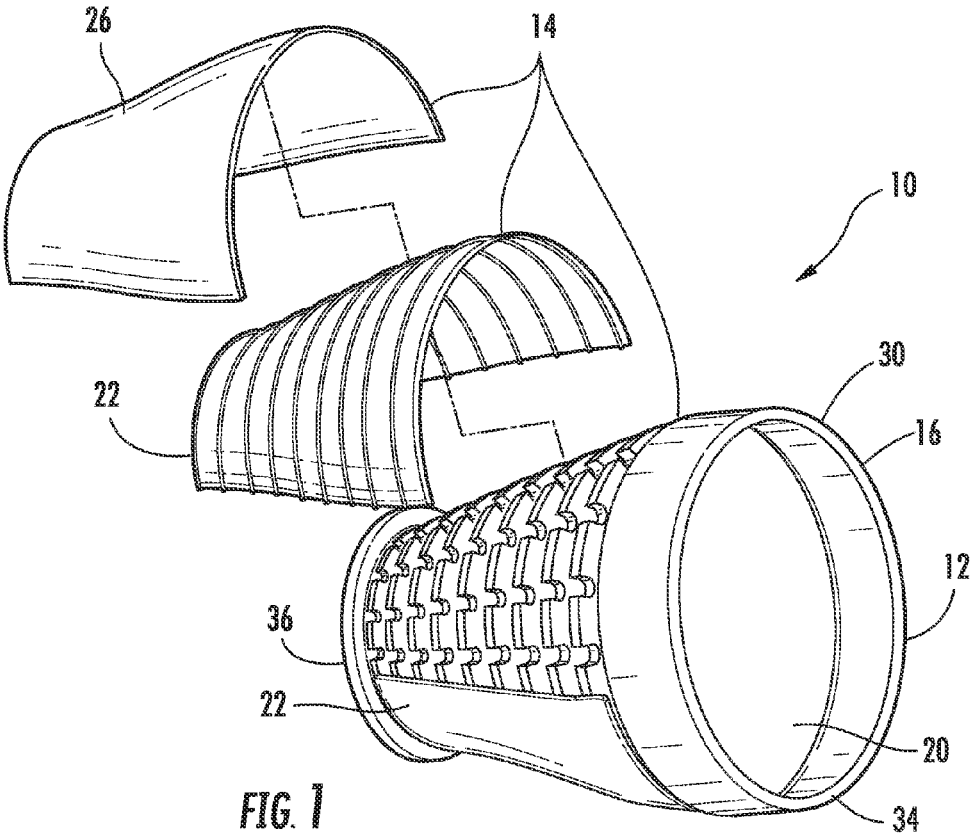
FIG. 1 is an exploded perspective view of a turbine engine component, such as a transition duct, having aspects of the invention.
Figure 2:
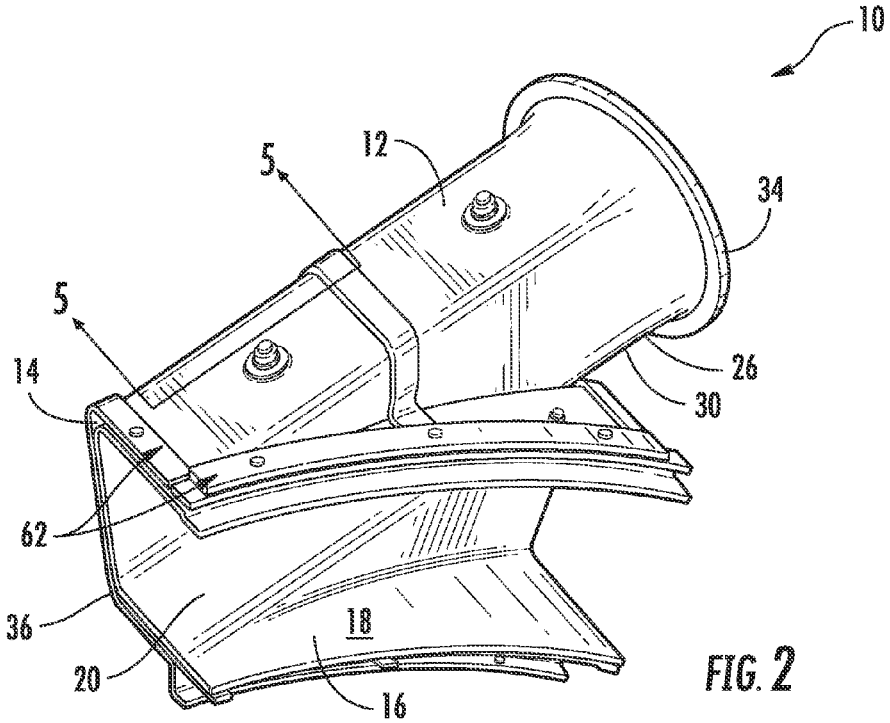
FIG. 2 is a perspective view of an alternative embodiment of a turbine engine component.
Figure 3:
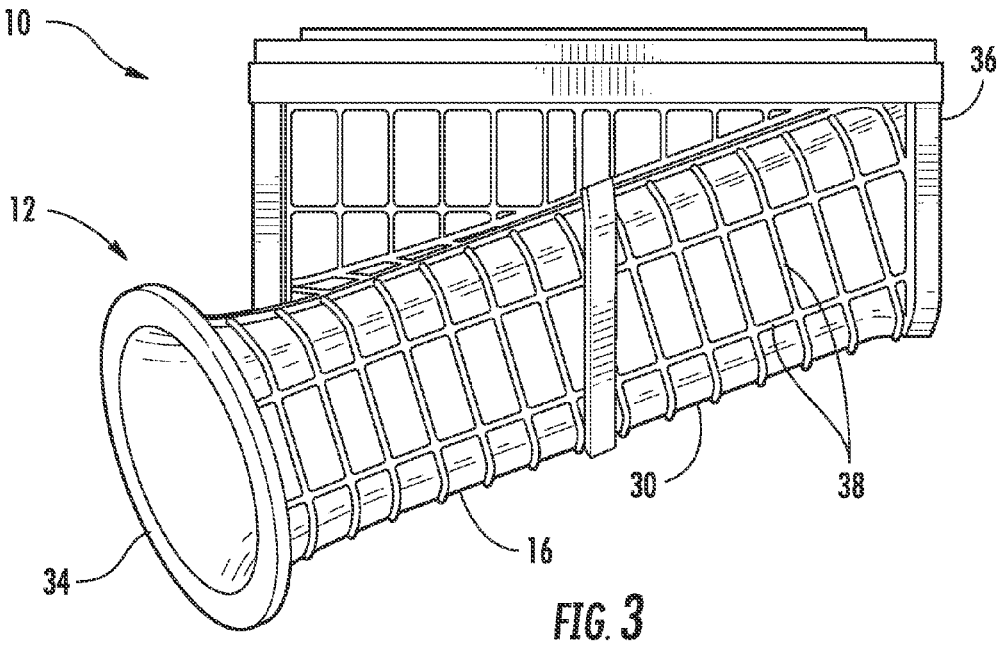
FIG. 3 is a top view of the transition shown in FIG. 2 with only the inner panel shown.
Figure 4:
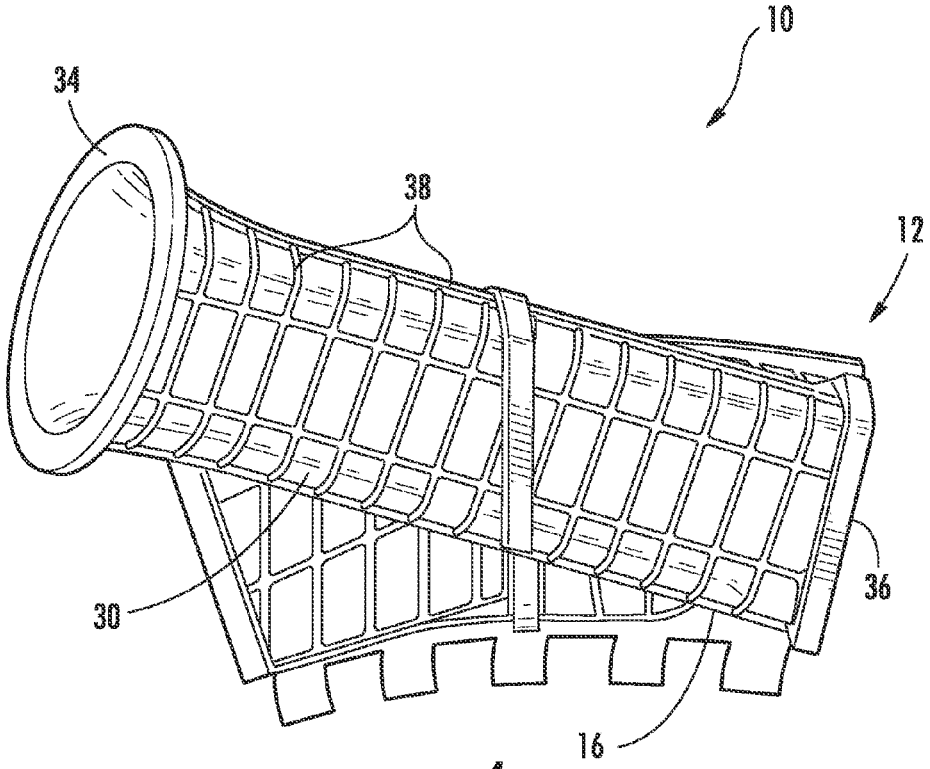
FIG. 4 is an axial view of the transition shown in FIG. 2 with only the inner panel shown.

In at least one embodiment, the inner panel 16 may be formed as a structural support to support itself and the intermediate and outer panels 22, 26. The inner panel 16 may have any appropriate configuration. The inner panel 16 may have a generally conical, cylindrical shape, as shown in FIG. 1, may be an elongated tube with a substantially rectangular cross-sectional area referred to as a transvane in which a transition section and a first row of vanes are coupled together, as shown in FIGS. 2-4, or another appropriate configuration. The outer panel 26 may be formed as a partial cylindrical structure such that two or more outer panels 26 are needed to form a cylindrical structure. Similarly, the intermediate panel 22 may be formed as a partial cylindrical structure such that two or more outer panels 26 are needed to form a cylindrical structure. The cylindrical outer and intermediate panels 26, 22 may be configured to mesh with the inner panel 16 and may be generally conical. The outer panel 26 may be configured to withstand a high pressure differential load. In particular, the outer panel 26 may be stiff relative to the intermediate and inner panels 22, 16, thereby transmitting most of the pressure loads off of the hot structure and onto attachment points.

In another embodiment, as shown in FIG. 11, the cooling system 10 may be formed from inner panel 16 and intermediate panel 22 without an outer panel 26. The impingement holes 29 in the intermediate panel 22 may be sufficient to function without an outer panel 26 with metering holes 28.

Figure 15:
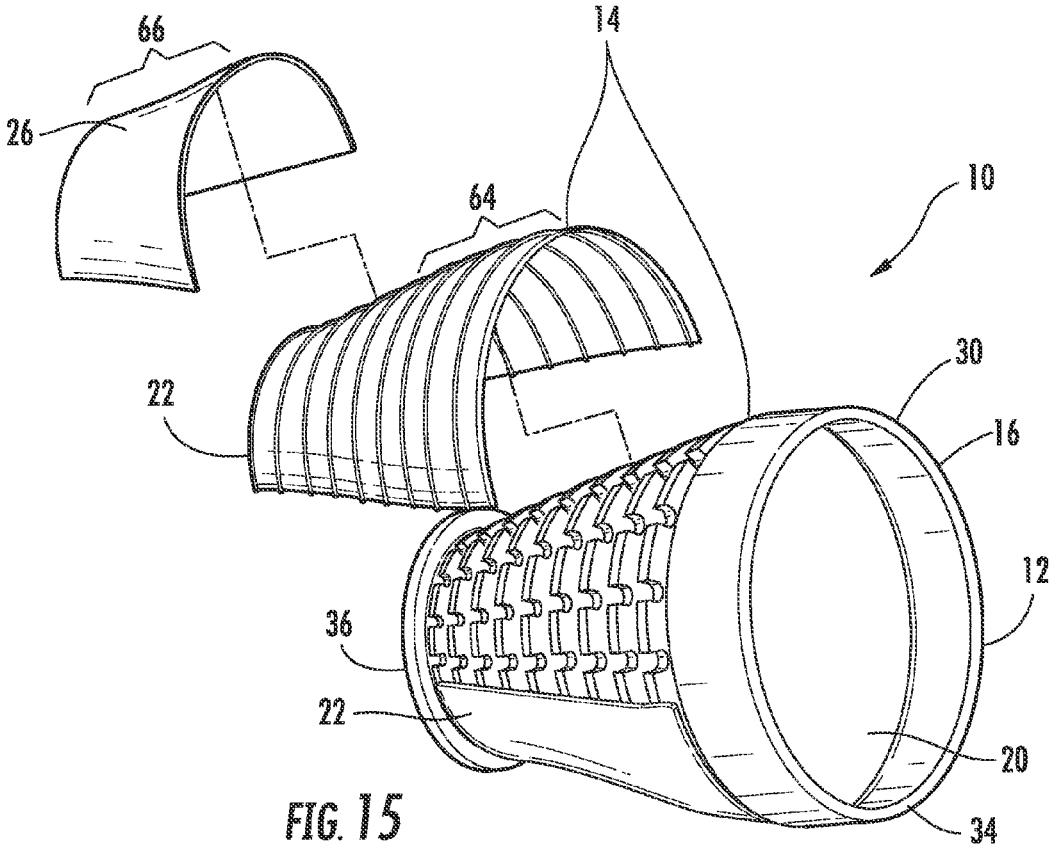
FIG. 15 is a partial cross-sectional side view of an alternative transition duct.

In another embodiment, as shown in FIG. 15, the turbine component may be formed from two sections that are differently configured. In an embodiment in which the turbine component is a transition duct 12, an upper section 64 may be formed from a two layer system and a lower section 66, which is downstream from the upper section 64, may be formed from a three layer system. In particular, the upper section 64 may be formed from an inner panel 16 and an intermediate panel 22 without an outer panel 26. The lower section 66 may be formed from an inner panel 16, an intermediate panel 22 and an outer panel 26. The lower section 66 may be included in a location of high velocity. The relative size of the lower and upper sections 66, 64 may change depending on the particular engine into which the transition duct 12 is installed.

Figure 5:
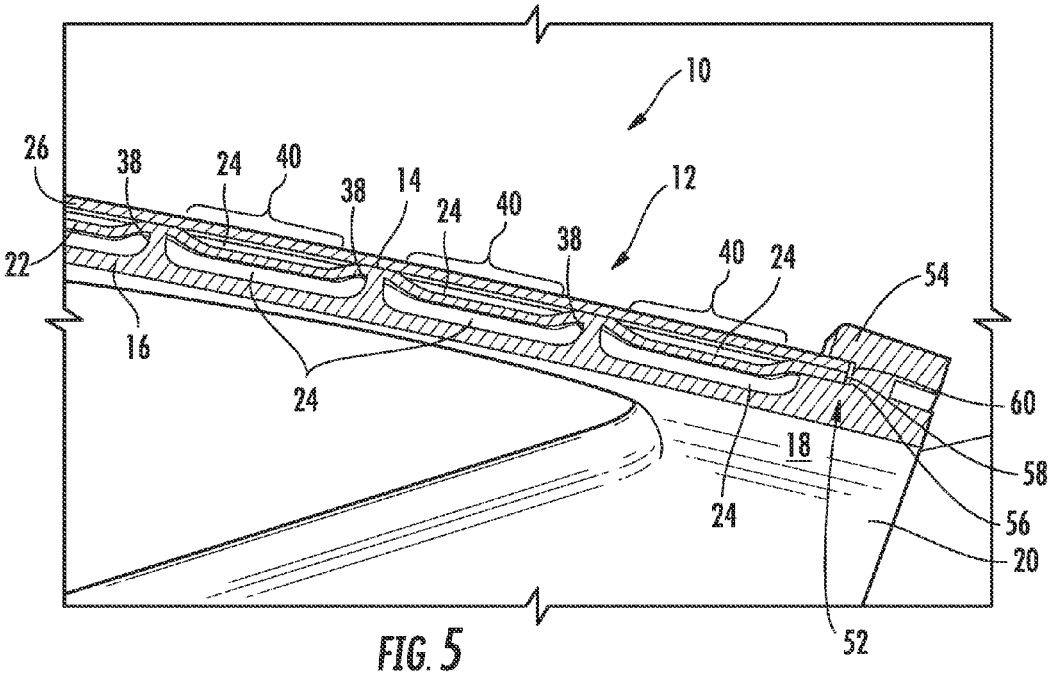
FIG. 5 is a perspective cross-sectional view of a multi-panel outer wall taken at section line 5-5 in FIG. 2.
Figure 6:
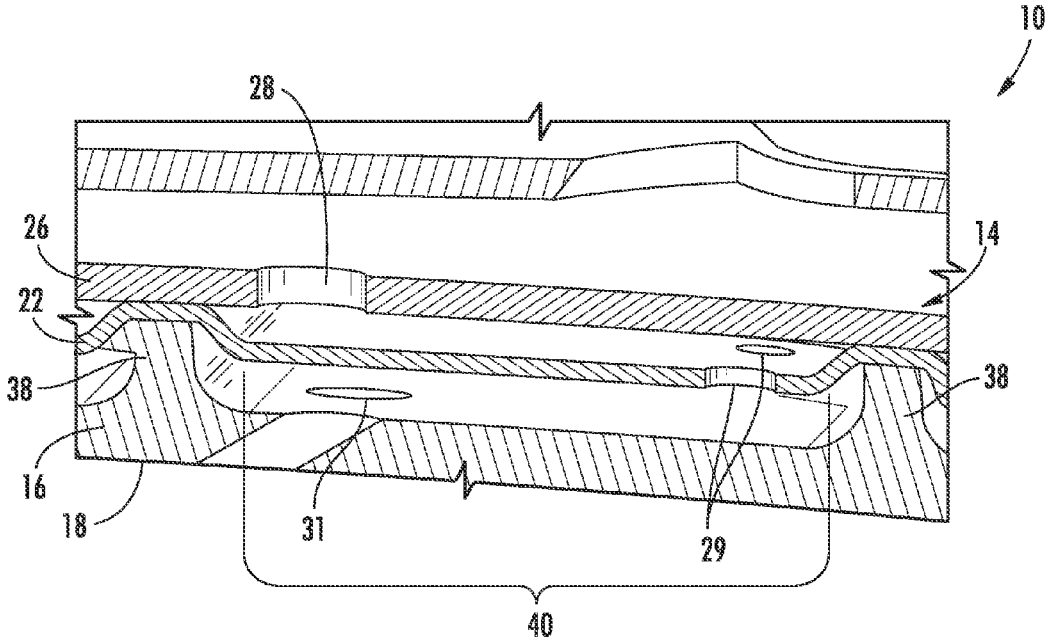
FIG. 6 is a detailed cross-sectional view taken at detail line 6-6 in FIG. 5.
Figure 12:
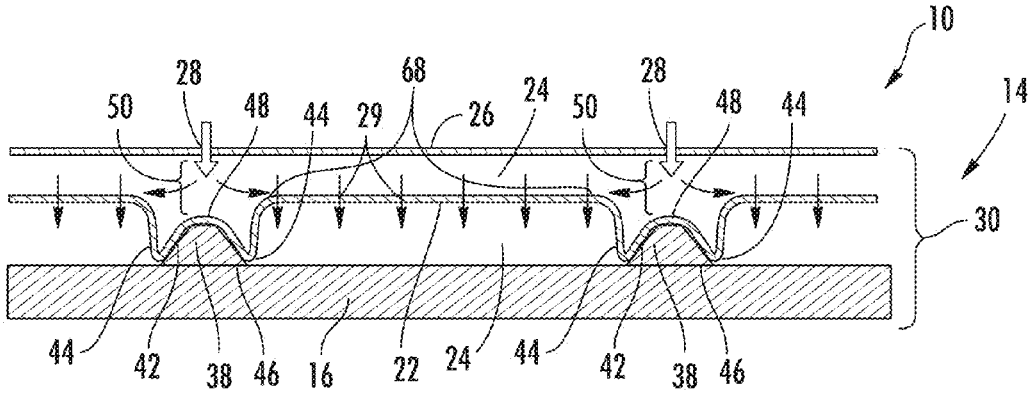
FIG. 12 is a partial cross-sectional view of another alternative embodiment of the multi-panel wall.
Figure 13:
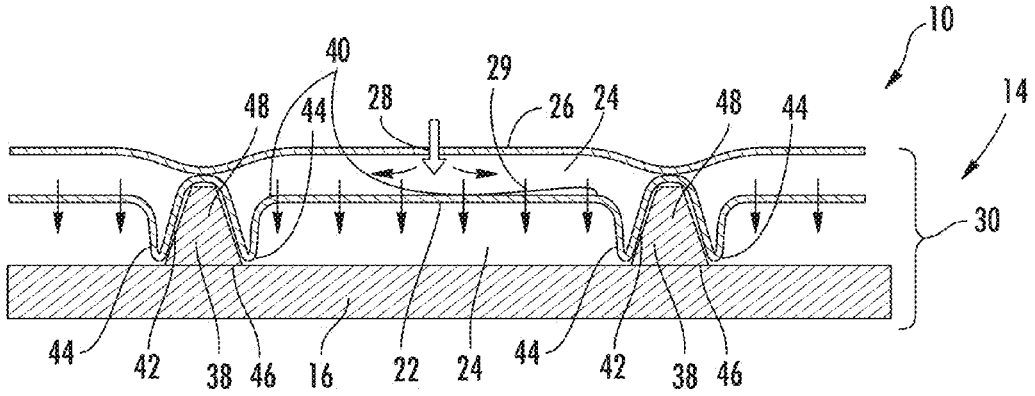
FIG. 13 is a partial cross-sectional view of yet another alternative embodiment of the multi-panel wall.

The multi-panel outer wall 14 may be configured such that cooling chambers 24 are formed between the inner and intermediate panels 16, 22 and between the intermediate and outer panels 22, 26. The cooling system 10 may include one or more ribs 38 extending from the inner panel 16 radially outward into contact the intermediate panel 22. The rib 38 may have any appropriate configuration, The rib 38 may have a generally rectangular cross-section, as shown in FIGS. 5 and 6, may have a generally tapered cross-section, as shown in FIGS. 11-13, or any other appropriate configuration. The tapered cross-section may be configured such that a cross-sectional area of the rib 38 at the base 46 is larger than a cross-sectional area of the rib 38 at an outer tip 48. The benefits of a tapered rib 38 include improved casting properties, such as, but not limited to, mold filling and solidification, removal of shell, et cetera, and better fin efficiency which reduces thermal stresses. Tapering the ribs 38 makes for a more uniform temperature distribution and less thermal stress between the cold ribs and the hot pocket surface.

Figure 16:
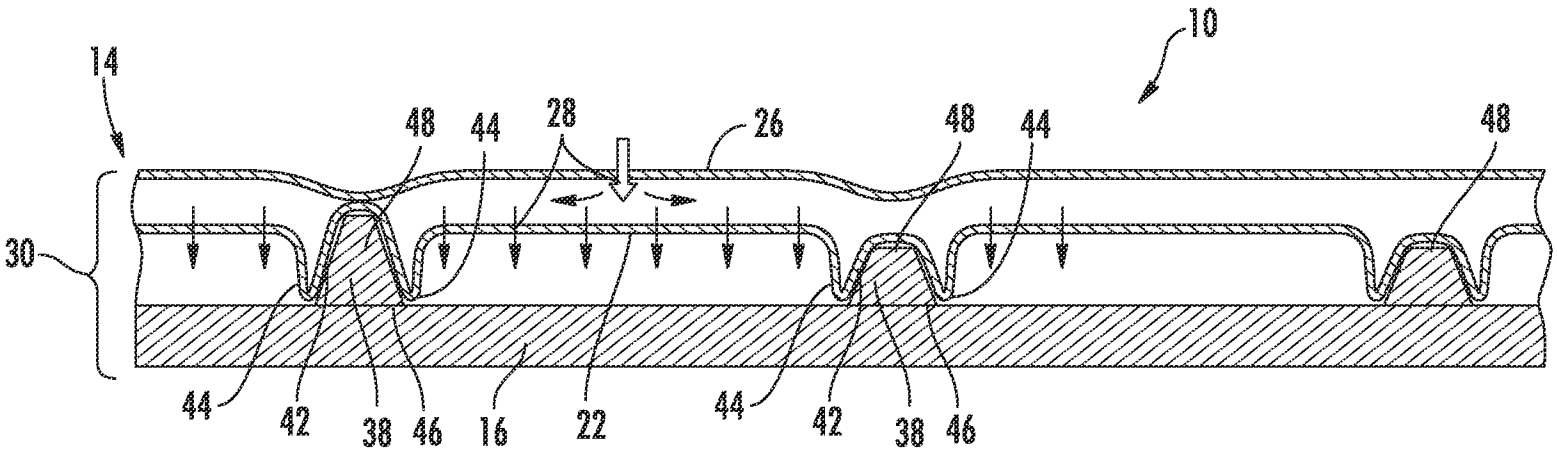
FIG. 16 is a partial cross-sectional view of another alternative embodiment of the multi-panel wall.

As shown in FIG. 16, the ribs 38 may have differing heights from the inner panel 16. As such, the configuration of the intermediate panel 22 may differ to optimize the impingement cooling. In particular, the intermediate panel 22 may include a depression 40 for situations where the intermediate panel 22 needs to be closer to the inner panel 16 for optimal impingement because the height of the ribs 38 is larger than the optimal height. In another situation, the intermediate panel 22 may include a raised section 68 for situations where the intermediate panel 22 needs to be further from the inner panel 16 for optimal impingement because the height of the ribs 38 is less than the optimal height. In another embodiment, the intermediate panel 22 may include neither a depression 40 nor a raised section 68 such as in the case where the rib 38 height and the optimal impingement distance are equal.

Figure 14:
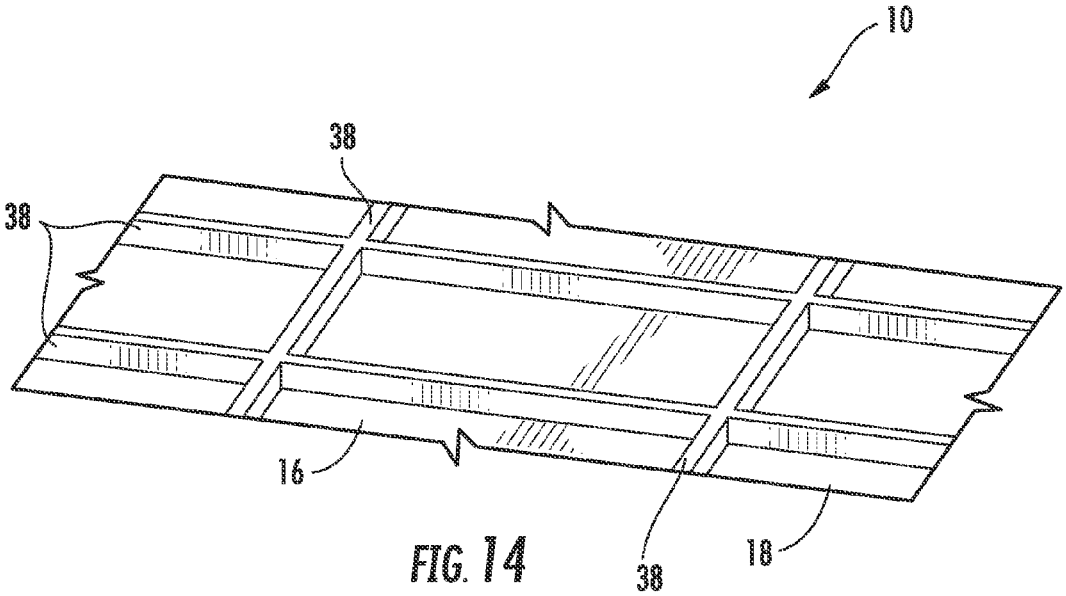
FIG. 14 is a partial perspective view of the outer side of the inner panel.

As shown in FIGS. 3, 4 and 14, the cooling system 10 may include a plurality of interconnected ribs 38. The ribs 38 may be aligned with each other. Some of the ribs 38 may be aligned in a first direction and some of the ribs 38 may be aligned in a second direction that is generally orthogonal to the first direction. In another embodiment, an isogrid type structure (triangular pockets) or hexagonal (honeycomb shape) shaped structure may also be used. The rib 38 spacing, height, width, and shape may vary from one part of the component to another.

As shown in FIGS. 5, 6 and 13, the intermediate panel may include one or more depressions 40 positioned between adjacent ribs 38 such that a volume of the cooling chamber 24 between the inner and intermediate panels 16, 22 is reduced when compared with a linear intermediate panel 22. The intermediate panel 22 may be supported by the ribs 38 and may contact the ribs 38. A portion of the intermediate panel 22 may straddle a rib 38 such that a support pocket 42 is formed in the intermediate panel 22. The support pocket 42 may be formed by a support side protrusion 44 formed on each side of the rib 38. Each support side protrusion 44 forming the support pocket 42 may extend radially inward toward the inner panel 16 further than other portions of the intermediate panel 22. The support pockets 42 may be shallow, as shown in FIGS. 5 and 6 or may be deep, as shown in FIGS. 11-13. As shown in FIGS. 11-13, the side support protrusions 44 forming the support pocket 42 may terminate in close proximity to the inner panel 16.

FIGS. 11-13 show not only an intermediate panel 22 with impingement holes 29 with a different height than the ribs 38, but also a method of protecting the ribs from excessive cooling. The ribs 38 may be colder than the hot pocket because the ribs 38 are surrounded by the coolant. This creates undesirably high thermal stresses. The intermediate impingement panel 22 is formed around the rib to shield them from direct impingement or circulation on the ribs 38, thereby making a more uniform temperature distribution in the transition duct.

In at least one embodiment, as shown in FIGS. 5, 6 and 13, the outer panel 26 may contact the intermediate panel 22 at a location radially aligned with a point at which the intermediate panel 22 contacts the rib 38. In one embodiment shown in FIG. 12, a gap 50 may exist between the intermediate panel 22 and the outer panel 26 at a location radially aligned with a point at which the intermediate panel 22 contacts the rib 38. As shown in FIG. 12, the gap 50 enables the formation of a large cooling chamber 24 that spans multiple ribs 38. As shown in FIG. 13, the cooling chambers 24 may be confined to the regions between adjacent ribs 38. The outer and intermediate panels 26, 22 shown in FIG. 13 may be bonded or otherwise attached together as one structure so that vibration and other dynamic loads do not cause excessive wear between the three members 16, 22 and 26.

Figure 7:
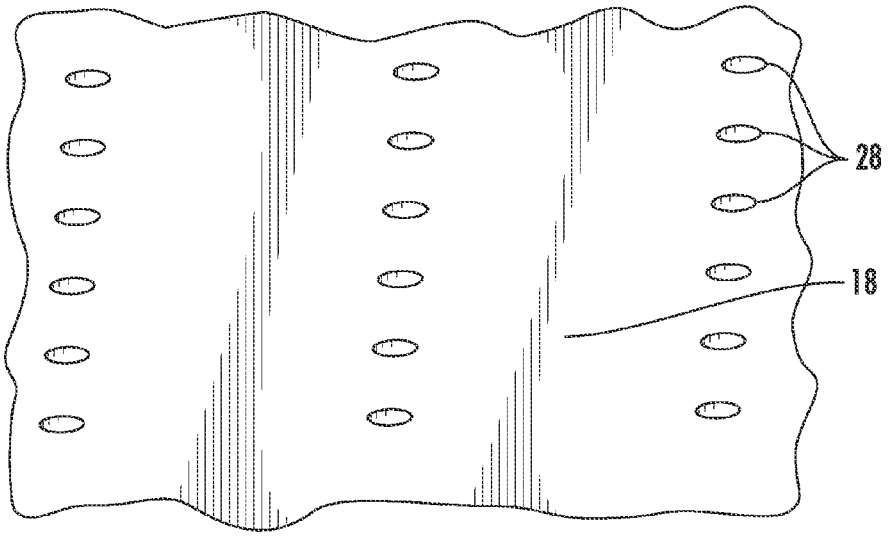
FIG. 7 is a partial detailed view of an inner surface of the inner panel.

As shown in FIG. 6, the multi-panel outer wall 14 may include one or more metering holes 28 for regulating the flow of cooling fluids through the outer wall 14 to cool the components forming the outer wall 14. In particular, the outer panel 26 may include one or more metering holes 28. The intermediate panel 22 may include one or more impingement holes 29, and the inner panel 16 may include one or more film cooling holes 31. The metering holes 28, impingement holes 29 and the film cooling holes 31 may have any appropriate size, configuration and layout. The metering holes 28 may be offset laterally from the impingement holes 29, and the film cooling holes 31 may be offset laterally from the impingement holes 29. As shown in FIG. 7, one or more of the film cooling holes 31 in the inner panel 16 may be positioned nonorthogonally relative to the inner surface 18 of the inner panel 16.

Figure 8:
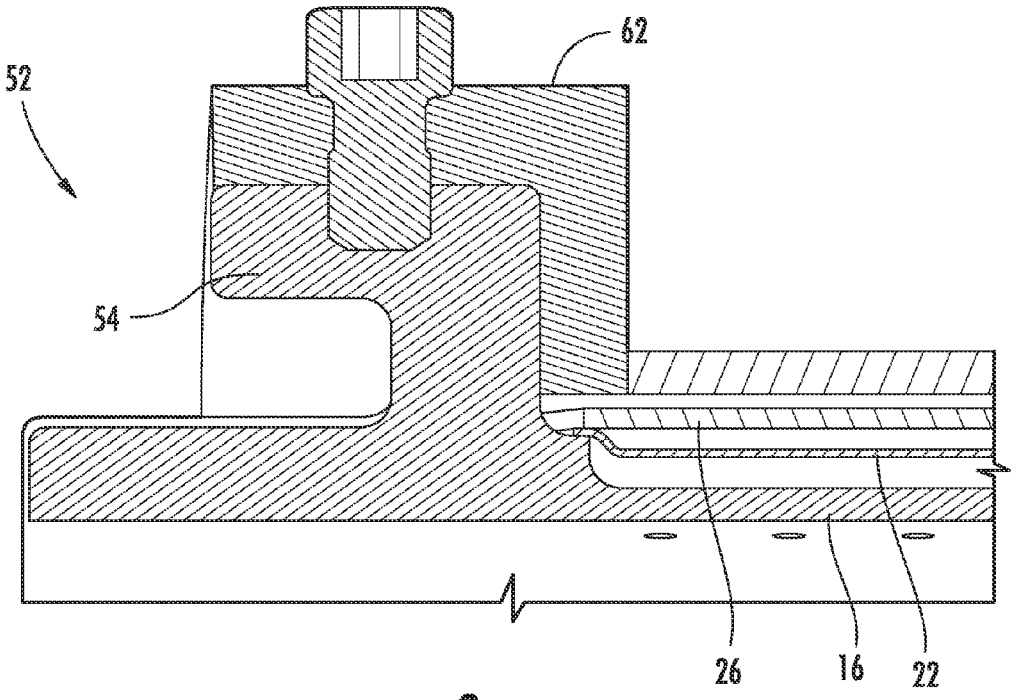
FIG. 8 is an attachment system for coupling the inner, intermediate and outer panels together.
Figure 9:
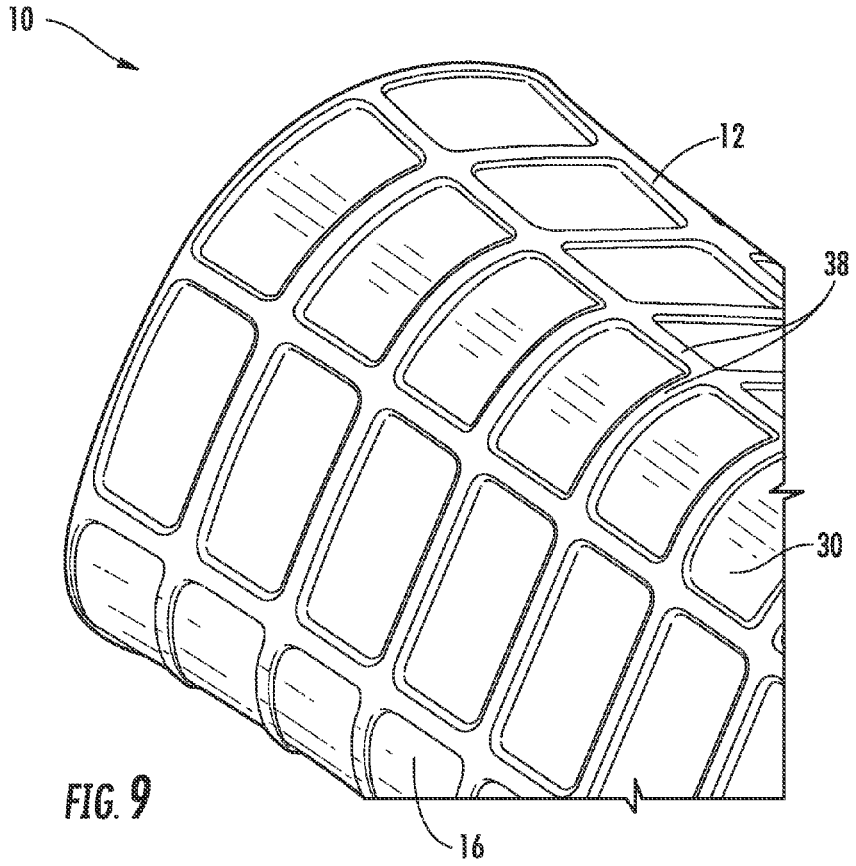
FIG. 9 is a partial perspective view of the inner panel.

An attachment system 52 may be used to construct the multi-panel outer wall 14. In particular, the attachment system 52 may include one or more seal bodies 54 integrally formed with the inner panel 16, as shown in FIGS. 5, 8 and 10. The seal body 54 may include at least one portion extending radially outward with one or more pockets 56 configured to receive a side edge 58 of the intermediate panel 22 in a sliding arrangement such that the intermediate panel 22 is able to move in-plane relative to the attachment system 52. The pocket 56 may also be configured to receive a side edge 60 of the outer panel 26 in a sliding arrangement such that the outer panel 26 is able to move in-plane relative to the attachment system 52. A sealing bracket 62, as shown in FIG. 8, may be releasably coupled to the seal body 54 such that the seal bracket 62 imposes a compressive force directed radially inward on the inner and intermediate panels 16, 22.

During operation, hot combustor gases flow from a combustor into inlet 34 of the transition duct 12. The gases are directed through the hot gas path plenum 20. Cooling fluids, such as, but not limited to air, may be supplied to the shell and flow through the metering holes 28 in the outer panel 26 into one or more cooling chambers 24 wherein the cooling fluids impinge on the intermediate panel 22. The cooling fluids decrease in pressure and pass through the metering holes 28 in the intermediate panel 22 and impinge on the inner panel 16. The depressions 40 enable the impingement holes 29 to be positioned closer to the inner panel 16 thereby increasing the impingement effect on the inner panel 16. The cooling fluids increasing in temperature and pass through the film holes 31 in the inner panel 16 to form film cooling on the inner surface 18 of the inner panel 16.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A transition duct for routing gas flow in a combustion turbine subsystem that includes a first stage blade array having a plurality of blades extending in a radial direction from a rotor assembly for rotation in a circumferential direction, said circumferential direction having a tangential direction component, an axis of the rotor assembly defining a longitudinal direction, and at least one combustor located longitudinally upstream of the first stage blade array and located radially outboard of the first stage blade array, said transition duct, comprising:

a transition duct body having an internal passage extending between an inlet and an outlet;

wherein the duct body is formed at least in part from a multi-panel outer wall; and wherein the multi-panel outer wall is formed from an inner panel having an inner surface that defines at least a portion of a hot gas path plenum and an intermediate panel positioned radially outward from the inner panel such that at least one cooling chamber is formed between the inner and intermediate panels;

at least one rib extending from the inner panel radially outward into contact the intermediate panel;

an outer panel positioned radially outward from the intermediate panel such that at least one cooling chamber is formed between the intermediate and outer panels;

an attachment system comprising at least one seal body integrally formed with the inner panel and having at least one portion extending radially outward with at least one pocket configured to receive a side edge of the intermediate panel in a sliding arrangement such that the intermediate panel is able to move in-plane relative to the attachment system and to receive a side edge of the outer panel in a sliding arrangement such that the outer panel is able to move in-plane relative to the attachment system.

2. The transition duct of claim 1, wherein the at least one rib comprises a plurality of ribs extending radially outward from the inner panel.

3. The transition duct of claim 2, wherein the intermediate panel includes at least one depression between adjacent ribs such that a distance between the intermediate panel and the inner panel is optimized.

4. The transition duct of claim 3, wherein the intermediate panel is supported by the plurality of ribs, wherein a portion of the intermediate panel straddles a rib such that a support pocket is formed in the intermediate panel, wherein the support pocket is formed by a support side protrusion formed on each side of the rib, wherein each side of the support pocket extends radially inward toward the inner panel further than other portions of the intermediate panel.

5. The transition duct of claim 1, wherein the at least one rib is tapered such that a cross-sectional area of the at least one rib at the base is larger than a cross-sectional area of the at least one rib at an outer tip.

6. The transition duct of claim 1, wherein the outer panel contacts the intermediate panel at a location radially aligned with a point at which the intermediate panel contacts the at least one rib.

7. The transition duct of claim 1, wherein a gap exists between the intermediate panel and the outer panel at a location radially aligned with a point at which the intermediate panel contacts the at least one rib.

8. The transition duct of claim 1, wherein the outer panel includes at least one metering hole.

9. The transition duct of claim 8, wherein the inner panel includes at least one film cooling hole, the outer panel includes at least one metering hole, and the intermediate panel includes at least one impingement hole.

10. The transition duct of claim 1, further comprising a sealing bracket releasably coupled to the at least one seal body such that the seal bracket imposes a compressive force directed radially inward on the inner and intermediate panels.

11. The transition duct of claim 1, wherein the outer panel is formed as a partial cylindrical structure such that at least two outer panels form a cylindrical structure.

12. The transition duct of claim 1, wherein the intermediate panel includes at least one impingement hole.

13. The transition duct of claim 1, wherein the inner panel includes at least one film cooling hole.

14. The transition duct of claim 1, wherein the intermediate panel is formed as a partial cylindrical structure such that at least two intermediate panels form a cylindrical structure.

* * * * *